US010551099B2

(12) United States Patent
Pautler et al.

(10) Patent No.: US 10,551,099 B2
(45) Date of Patent: Feb. 4, 2020

(54) MICRO-CHANNEL EVAPORATOR HAVING COMPARTMENTALIZED DISTRIBUTION

(71) Applicant: MAHLE International GmbH, Stuttgart (DE)

(72) Inventors: Donald R Pautler, Lockport, NY (US); Douglas C Wintersteen, Burt, NY (US); Neil A Walkowski, Orchard Park, NY (US); Longhu Li, Williamsville, NY (US); Wayne O Forrest, Gasport, NY (US); Shrikant M Joshi, Williamsville, NY (US)

(73) Assignee: MAHLE International GmbH, Stuttgart (DE)

( * ) Notice: Subject to any disclaimer, the term of this patent is extended or adjusted under 35 U.S.C. 154(b) by 396 days.

(21) Appl. No.: 15/015,857

(22) Filed: Feb. 4, 2016

(65) Prior Publication Data

US 2017/0227264 A1 Aug. 10, 2017

(51) Int. Cl.
*F28F 9/02* (2006.01)
*F28D 1/053* (2006.01)
(Continued)

(52) U.S. Cl.
CPC ..... *F25B 39/00* (2013.01); *F25B 39/028* (2013.01); *F28D 1/05333* (2013.01); *F28F 1/126* (2013.01); *F28F 9/0243* (2013.01); *F28F 9/0268* (2013.01); *F28F 9/0273* (2013.01); *F28F 9/22* (2013.01); *F28D 1/05366* (2013.01); *F28D 2021/0071* (2013.01);
(Continued)

(58) Field of Classification Search
CPC .... F25B 39/00; F25B 39/028; F28D 1/05333; F28F 1/126; F28F 9/22; F28F 9/0273; F28F 9/0268; F28F 2260/02
See application file for complete search history.

(56) References Cited

U.S. PATENT DOCUMENTS 1,684,083 A 9/1928 Bloom
2,097,602 A 11/1937 Rohlin
(Continued)

FOREIGN PATENT DOCUMENTS

EP 2581696 A1 4/2013
WO 2015027783 A1 3/2015
(Continued)

*Primary Examiner* — Frantz F Jules
*Assistant Examiner* — Martha Tadesse
(74) *Attorney, Agent, or Firm* — Brinks Gilson & Lione

(57) ABSTRACT

An evaporator may be provided comprising a manifold, a plurality of micro-channel passageways, a distributor, and a separator. The manifold may comprise a shell defining a cavity. The plurality of micro-channel passageways may extend outwardly from the shell of the manifold, wherein the cavity may be in fluid communication with the plurality of micro-channel passageways. The distributor may comprise an inlet, an elongated body extending into the cavity of the manifold and defining a lumen, and a plurality of openings arranged on an outer surface of the elongated body and spaced along a length of the elongated body, wherein the openings may be configured to allow fluid communication between the lumen and the cavity of the manifold. The separator may be positioned between the plurality of openings within the cavity of the manifold.

18 Claims, 5 Drawing Sheets

(51) Int. Cl.

| | |
|---|---|
| ***F28F 9/22*** | (2006.01) |
| ***F28F 1/12*** | (2006.01) |
| ***F25B 39/00*** | (2006.01) |
| ***F25B 39/02*** | (2006.01) |
| *F28D 21/00* | (2006.01) |
| *F28F 1/02* | (2006.01) |

(52) U.S. Cl.
CPC ..... *F28F 1/022* (2013.01); *F28F 9/0209* (2013.01); *F28F 9/0212* (2013.01); *F28F 2009/224* (2013.01); *F28F 2009/226* (2013.01); *F28F 2260/02* (2013.01)

(56) References Cited

U.S. PATENT DOCUMENTS 2,759,248 A 8/1956 Burgess
3,605,882 A 9/1971 Smith et al.
3,976,128 A * 8/1976 Patel ..... F25B 39/02 165/153
4,593,539 A 6/1986 Humpolik et al.
4,936,381 A 6/1990 Alley
5,097,898 A 3/1992 Verkaart
5,186,248 A * 2/1993 Halstead ..... B60H 1/3227 165/153
5,203,407 A 4/1993 Nagasaka
5,445,219 A 8/1995 Hutto et al.
5,505,254 A 4/1996 Chiba
5,651,268 A 7/1997 Aikawa et al.
5,806,586 A 9/1998 Osthues et al.
5,836,382 A 11/1998 Dingle et al.
5,896,754 A 4/1999 Balthazard et al.
6,199,401 B1 * 3/2001 Haussmann ..... F25B 39/028 165/153
6,267,173 B1 7/2001 Hu et al.
6,651,334 B2 11/2003 Chikuma et al.
6,729,386 B1 * 5/2004 Sather ..... F28D 1/05316 165/110
7,275,394 B2 10/2007 Lundberg
7,287,578 B2 10/2007 Ricci et al.
7,484,555 B2 2/2009 Beamer et al.
7,549,466 B2 6/2009 Hayashi et al.
7,806,171 B2 10/2010 Taras et al.
7,819,177 B2 10/2010 Beamer et al.
7,832,231 B2 11/2010 Knight et al.
7,946,036 B2 5/2011 Beamer et al.
7,971,636 B2 7/2011 Higashiyama et al.
8,171,987 B2 5/2012 Jiang et al.
8,281,615 B2 10/2012 Tucker et al.
8,408,284 B2 * 4/2013 Polisoto ..... F28D 1/05366 165/174
2003/0010483 A1 1/2003 Ikezaki et al.
2004/0159121 A1 8/2004 Horiuchi et al.
2005/0132744 A1 6/2005 Rohrer et al.
2006/0102331 A1 5/2006 Taras et al.
2006/0130517 A1 6/2006 Merkys et al.
2006/0162918 A1 7/2006 Horiuchi et al.
2006/0185167 A1 8/2006 Lippa, Jr. et al.
2007/0062678 A1 3/2007 Hayashi et al.
2007/0158057 A1 7/2007 Higashiyama
2007/0256821 A1 11/2007 Mashiko et al.
2008/0023185 A1 1/2008 Beamer et al.
2008/0078541 A1 4/2008 Beamer et al.
2008/0093051 A1 * 4/2008 Rios ..... F25B 41/067 165/61
2009/0107171 A1 4/2009 Brodie et al.
2009/0229805 A1 * 9/2009 Beamer ..... B23P 15/26 165/174
2009/0293535 A1 12/2009 Aung et al.
2010/0089095 A1 4/2010 Macri et al.
2010/0089559 A1 4/2010 Gorbounov et al.
2010/0206535 A1 * 8/2010 Munoz ..... F25B 39/028 165/173
2010/0300667 A1 12/2010 Samuelson
2011/0000255 A1 1/2011 Taras et al.
2011/0017438 A1 1/2011 Huazhao et al.
2011/0203308 A1 8/2011 Chiang et al.
2011/0240276 A1 * 10/2011 Wintersteen ..... F28D 1/05383 165/173
2011/0290465 A1 * 12/2011 Joshi ..... F28F 9/0273 165/175
2012/0279692 A1 * 11/2012 Polisoto ..... F28D 1/05366 165/175
2013/0168070 A1 7/2013 Samuelson

FOREIGN PATENT DOCUMENTS

WO WO 2015142615 A1 * 9/2015 ..... F28F 9/0209
WO WO-2015142615 A1 * 9/2015

* cited by examiner

MICRO-CHANNEL EVAPORATOR HAVING COMPARTMENTALIZED DISTRIBUTION

TECHNICAL FIELD

This disclosure relates to evaporators for cooling systems and, in particular, to micro-channel evaporators for air conditioning and refrigeration systems.

BACKGROUND

The statements in this section merely provide background information related to the present disclosure and may not constitute prior art.

Cooling systems such as refrigeration and air conditioning systems employ evaporators to absorb heat from the environment to be cooled. Cooling fluid passes through the evaporator and undergoes a change of state while proceeding from the inlet to the outlet. Micro-channels increase the efficiency of thermal exchange across the evaporator, commonly requiring only a single pass through the environment to be cooled. However, cooling fluid entering an evaporator manifold from an inlet distributor often retains at least some momentum in the flow direction of the distributor, resulting in uneven distribution of the cooling fluid into the micro-channels. This problem is particularly relevant in evaporators using micro-channels, as the small cross-sections of the micro-channel inlets may restrict flow into the micro-channels and enhance downstream momentum effects. As a result of these downstream momentum effects, the cooling fluid concentration may be substantially higher at the micro-channels located at the downstream end of the manifold. As a result of this uneven distribution, the cooling fluid in the downstream micro-channels undergoes heat exchange which is less effective and upstream micro-channels operate at below their cooling fluid capacity. Therefore, a distributor and manifold which evenly distributes cooling fluid into the micro-channels is desirable.

SUMMARY

Further areas of applicability will become apparent from the description provided herein. It should be understood that the description and specific examples are intended for purposes of illustration only and are not intended to limit the scope of the present disclosure.

In one embodiment, an evaporator is provided comprising a manifold, a plurality of micro-channel passageways, a distributor, and a separator. The manifold comprises a shell defining a cavity. The plurality of micro-channel passageways extends outwardly from the shell of the manifold, wherein the cavity is in fluid communication with the plurality of micro-channel passageways. The distributor comprises an inlet, an elongated body extending into the cavity of the manifold and defining a lumen, and a plurality of openings arranged on an outer surface of the elongated body and spaced along a length of the elongated body, wherein the openings are configured to allow fluid communication between the lumen and the cavity of the manifold. The separator is positioned between the plurality of openings within the cavity of the manifold.

In another embodiment, an evaporator is provided, comprising an inlet manifold, a separator, a plurality of micro-channel passageways, and an outlet manifold. The inlet manifold comprises an inlet and a shell defining a cavity, the inlet manifold being configured to receive a distributor. The separator is positioned along the length of the distributor within the cavity of the manifold. The plurality of micro-channel passageways extends outwardly from the shell of the outlet manifold. The plurality of micro-channel passageways comprises a first end and a second end, wherein the first end is in fluid communication with the cavity of the inlet manifold. The outlet manifold is in fluid communication with the second end of the plurality of micro-channel passageways.

In yet another embodiment, a method of manufacturing an evaporator is provided comprising providing a manifold, positioning a separator within the manifold, and inserting a distributor into the manifold. The manifold comprises a shell defining a cavity. The manifold is coupled to a plurality of micro-channel passageways which extend outwardly from manifold wherein the cavity is in fluid communication with the plurality of micro-channel passageways. The separator is positioned within the cavity of the manifold. The distributor is inserted into the cavity of the manifold, where the distributor comprises an inlet, an elongated body extending into the cavity of the manifold and defining a lumen, and a plurality of openings arranged on an outer surface of the elongated body and spaced along a length of the elongated body. The openings are configured to allow fluid communication between the lumen and the cavity of the manifold.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
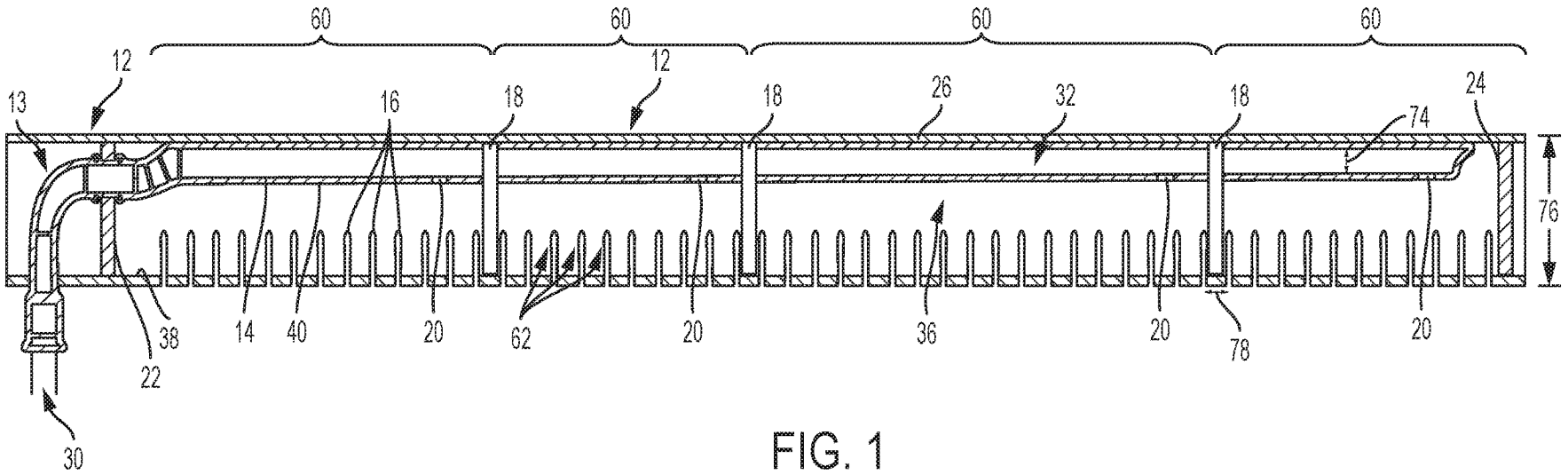
FIG. 1 illustrates a top-down cross-sectional view of a first example of a manifold comprising a distributor, separators, and micro-channels.

FIG. 1 illustrates a cross-sectional view of a first example of an inlet manifold 12 comprising a shell 26 which defines a cavity 36 within the shell 26. The inner surface 38 of the shell 26 faces toward the cavity 36. The shell 26 may be any object which receives cooling fluid from an inlet 30 and allows fluid communication of that cooling fluid to a plurality of micro-channel passageways 16 extending outward from the inlet manifold 12. For example, the shell 26 may have a shape which is rectangular or circular and may comprise a material such as 3003 series aluminum alloy or another metal alloy. The inlet manifold 12 further comprises a first end 22 and a second end 24 which substantially seal the shell 26 and prevent cooling fluid from escaping the inlet manifold 12 except through the plurality of micro-channel passageways 16. One of either the first end 22 or second end 24 comprises an opening by which a distributor 13 may be inserted within the inlet manifold 12. The opening in the first end 22 or second end 24 may be secured by a sealing mechanism such as a gasket to prevent cooling fluid from escaping the inlet manifold 12. The cavity 36 has a width or diameter 76 between 2 mm and 50 mm.

Figure 6:
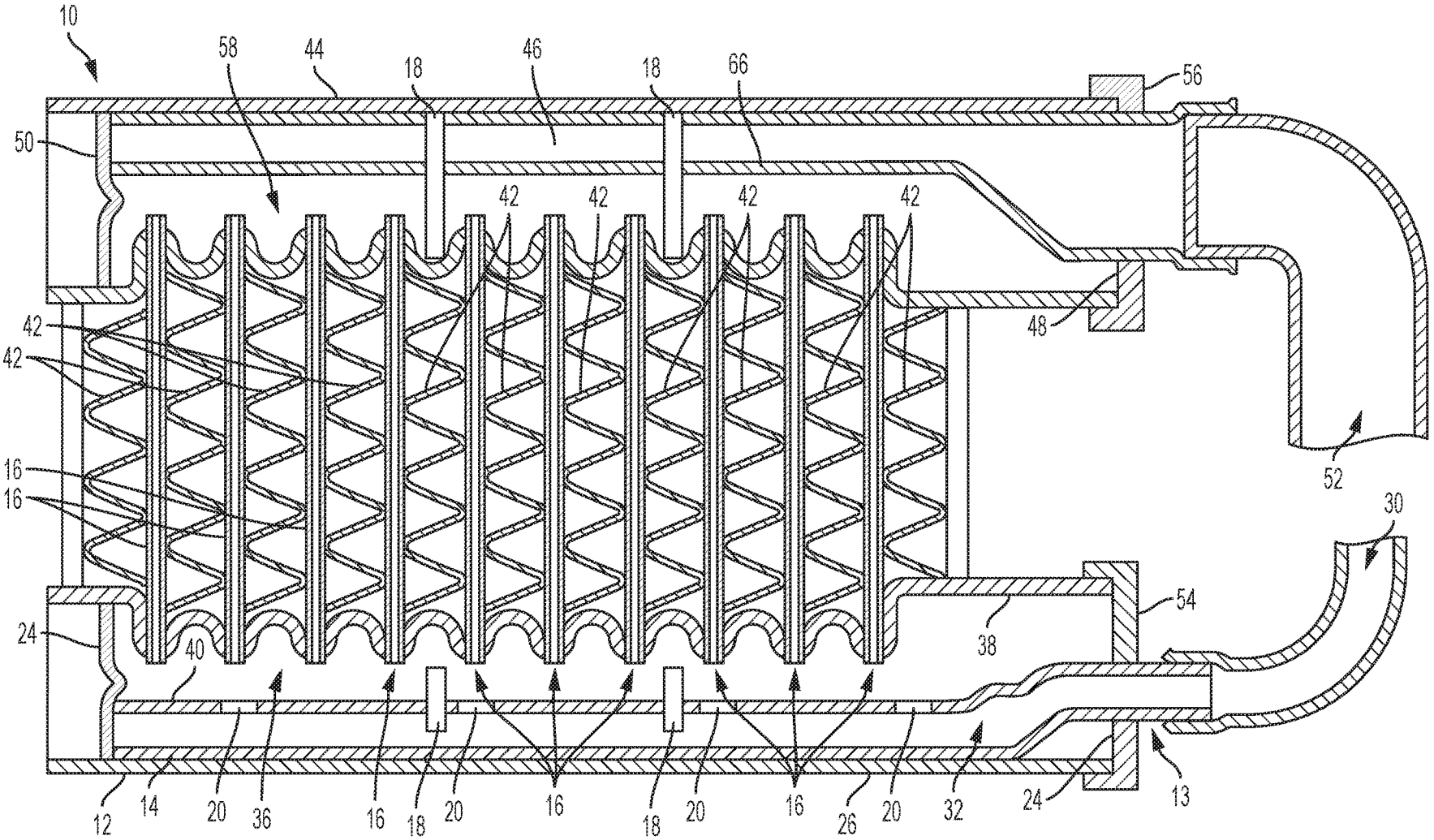
FIG. 6 illustrates a cross-sectional view of an example of an evaporator comprising an inlet manifold, an outlet manifold, a distributor, a collector, and micro-channel passageways.

The distributor 13 comprises an inlet 30 and an elongated body 14 extending into the cavity 36. The elongated body 14 defines a lumen 32 and comprises an outer surface 40 and a plurality of openings 20 spaced along the length of the elongated body 14. The plurality of openings 20 allow fluid communication between the lumen 32 and the cavity 36. The lumen 32 is in fluid communication with the inlet 30 such that cooling fluid in a cooling system proceeding from an expansion valve or condenser (not shown) proceeds into the evaporator (10 in FIG. 6) from the inlet 30 of the distributor 13, through the lumen 32 of the elongated body 14, into the cavity 36 of the inlet manifold 12, and into the plurality of micro-channel passageways 16. The elongated body 14 of the distributor 13 may have any cross-sectional shape conducive for delivering cooling fluid to the cavity 36, such as a rectangular, circular, or semi-circular cross-sectional shape. The elongated body 14 may comprise a material such as a 3003 series aluminum alloy or another metal alloy. The distal end of the elongated body 14 may be sealed to force cooling fluid to escape from the lumen 32 through the plurality of openings 20. The plurality of openings 20 may take any form which allows cooling fluid to pass from the lumen 32 to the cavity 36. Examples of possible shapes for the plurality of openings 20 include circles or rectangular slots. The plurality of openings 20 may be spaced evenly along the length of the elongated body 14 or may be spaced unevenly to encourage even distribution of the cooling fluid into the cavity 36 and into the plurality of micro-channel passageways 16. The openings 20 are sized between 0.5 mm and 5.0 mm. The openings are spaced between 40 mm and 80 mm apart along the length of the elongated body 14.

The lumen 32 has a width or diameter 78 between 4 mm and 12 mm.

A separator 18 is positioned within the cavity 36 of the inlet manifold 12. The separator 18 is positioned between the plurality of openings 20, dividing the cavity 36 into a plurality of compartments 60. The separators 18 may comprise any object placed in the cavity 36 which occupies a portion of the cross-sectional area of the cavity 36, such as a plate, a flange, or a protrusion.

A plurality of separators 18 is positioned in the cavity 36 as shown in FIG. 1. The plurality of separators 18 may be positioned with uniform spacing between the first end 22 and second end 24 of the inlet manifold 12, or may be spaced unevenly along the length of within the cavity 36 to encourage even flow and distribution of cooling fluid into the plurality of micro-channel passageways 16. The separators 18 may be placed in proximity to one of the openings 20 to influence the flow of cooling fluid exiting from the opening 20. The separators 18 may be placed downstream from one of the openings 20 to act as a barrier for cooling fluid escaping from the openings 20. Where the separator 18 is placed immediately downstream of one of the openings 20, the separator 18 may counter the residual downstream momentum of the cooling fluid and assist in changing the motion of the cooling fluid toward the closest of the plurality of micro-channel passageways 16 positioned laterally from the opening 20.

Each of the plurality of compartments 60 created by the separators 18 may be isolated from any other compartment 60, or may be in fluid communication with the other compartments 60. Each compartment 60 is a portion of the cavity 36 which is (a) between two separators 18, (b) between the first end 22 of the inlet manifold 12 and the nearest separator 18 to the first end 22, or (c) between the second end 24 of the inlet manifold 12 and the nearest separator 18 to the second end 24. The compartments 60 may have equivalent length and volume. Alternatively, the compartments 60 may have varying length and volume, depending on the spacing of the separators 18 and the conditions suitable for even distribution of cooling fluid into the plurality of micro-channel passageways 16.

Figure 2:
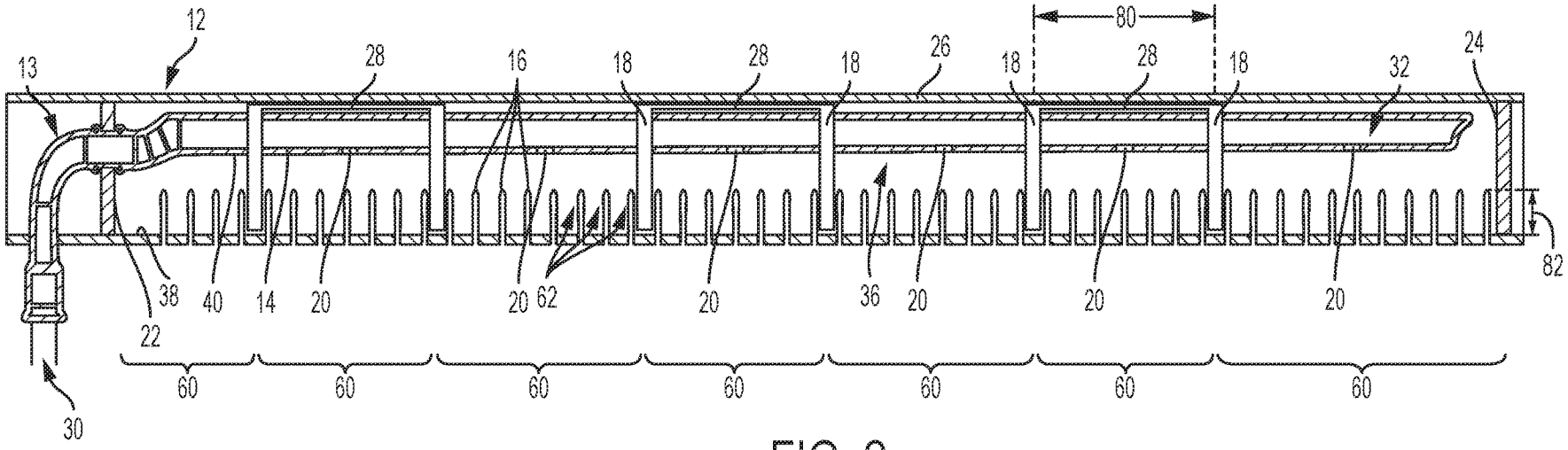
FIG. 2 illustrates a top-down cross-sectional view of a second example of a manifold comprising a distributor, separators, and micro-channels.

FIG. 2 illustrates the inlet manifold 12 comprising the plurality of separators 18 in the cavity 36, where two or more of the separators 18 are coupled to a bracket 28 which spans a length of the cavity 36 between the separators 18. The bracket 28 provides structural support for the separators 18 and may be welded or brazed to an inner surface 38 of the shell 26 to prevent movement of the separators 18 within the cavity 36. Where the separators 18 span the entire width of the cavity 36, the separators 18 and brackets 28 may also provide structural support for the inlet manifold 12. Such a configuration may also provide structural support for the elongated body 14 of the distributor 13, which may pass through the separators 18. The bracket 28 has a length 80 between 30 mm and 80 mm. The bracket 28 may be arranged within the cavity 36 such that at least one of the plurality of openings 20 falls between the separators 18 coupled to the bracket 28.

The separators 18 may be positioned to extend the entire width of the cavity 36, as shown in FIG. 1. In such a configuration, the separators 18 may be positioned in spacer regions 62 of the cavity 36 between two of the plurality of micro-channel passageways 16. The separators 18 may have a thickness 78 which spans the length of the spacer regions 62 and occupies the entire length between two of the plurality of micro-channel passageways 16. Thicker separators 18 may provide additional structural support to the inlet manifold 12 and the elongated body 14. The thickness 78 of the separators 18 may vary between 0.5 mm and 5.0 mm.

Figure 3:
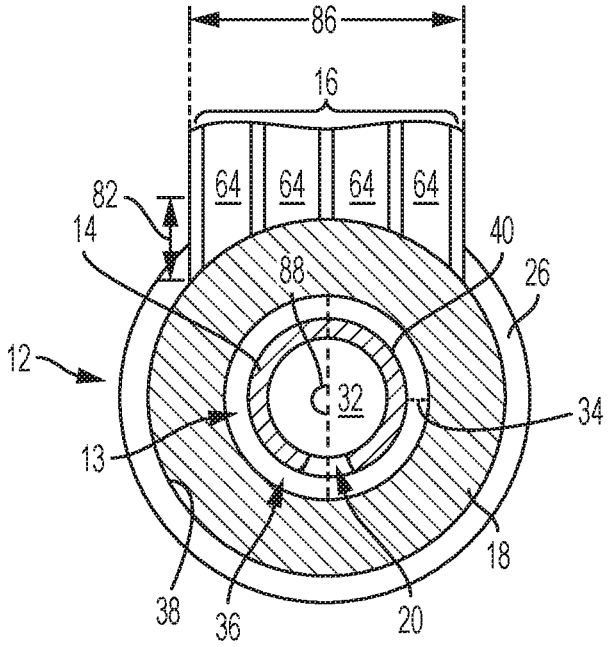
FIG. 3 illustrates a side cross-sectional view of a third example of a manifold comprising a distributor, a separator, and micro-channels.

FIG. 3 illustrates the inlet manifold 12 shown from a side cross-sectional view. As shown in FIG. 3, the elongated body 14 is substantially centered within the cavity 36 such that the outer surface 40 of the elongated body 14 is spaced away from the inner surface 38 of the shell 26. As shown, the separator 18 extends around the entire circumference of the elongated body 14 and substantially occludes the cavity 36, such that flow of cooling fluid downstream from the opening 20 is substantially prevented.

The separator 18 may be coupled to and extend inwardly from the inner surface 38 of the shell 26. The separator 18 may extend about the entire inner surface 38 of the shell 26, giving structural support to the inlet manifold 12. The separator 18 may extend inwardly sufficient to contact the outer surface 40 of the elongated body 14 preventing movement of the elongated body 14 within the inlet manifold 12. Alternatively, a gap 34 may exist between the most inward portion of the separator 18 and the outer surface 40 of the elongated body 14, which may allow the elongated body to be easily removed from the inlet manifold 12 for repairs or maintenance. It is desirable to minimize the gap 34 to increase the effectiveness of the separators 18 in influencing the flow of the cooling fluid escaping from the opening 20.

The plurality of micro-channel passageways 16 extends into the cavity 36, as shown in FIG. 3. Each of the plurality of micro-channel passageways 16 are arranged in rows of individual micro-channels 64. Each of the plurality of micro-channel passageways 16 are spaced along the length of the inlet manifold 12, while the individual micro-channels 64 are spaced within and across the width of the micro-channel passageways 16. Each of the micro-channels 64 may comprise any cross-sectional shape which allows substantial heat transfer with an outer surface of the micro-channel passageways 16. For example, the micro-channels 64 may have a rectangular cross-sectional shape such that they can be easily arranged along the width of the micro-channel passageways 16 and also maximize heat transfer with the outer surface of the micro-channel passageways 16. Alternatively, the micro-channels 64 may have a circular or triangular cross-sectional shape. The number of micro-channels 64 within a micro-channel passageway is between 12 and 32. The width 86 of the micro-channel passageways 16 is between 10 mm and 50 mm. The width 84 of each individual micro-channel 64 is between 0.5 mm and 10 mm. The ratio between the width 84 of the micro-channels 64 over the length (the perpendicular cross-sectional dimension) of the micro-channels 64 is between 1 and 4. The micro-channel passageways 16 are separated from one another along the length of the inlet manifold 12 by between 6 mm and 12 mm.

Figure 4:
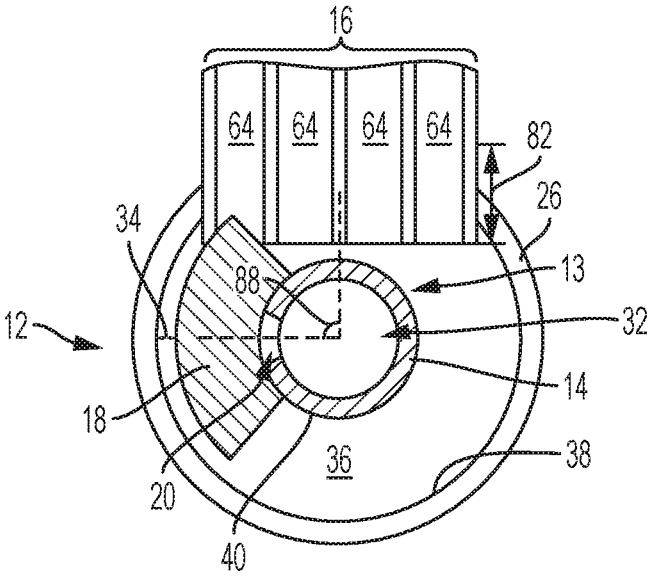
FIG. 4 illustrates a side cross-sectional view of a fourth example of a manifold comprising a distributor, a separator, and micro-channels.
Figure 5:
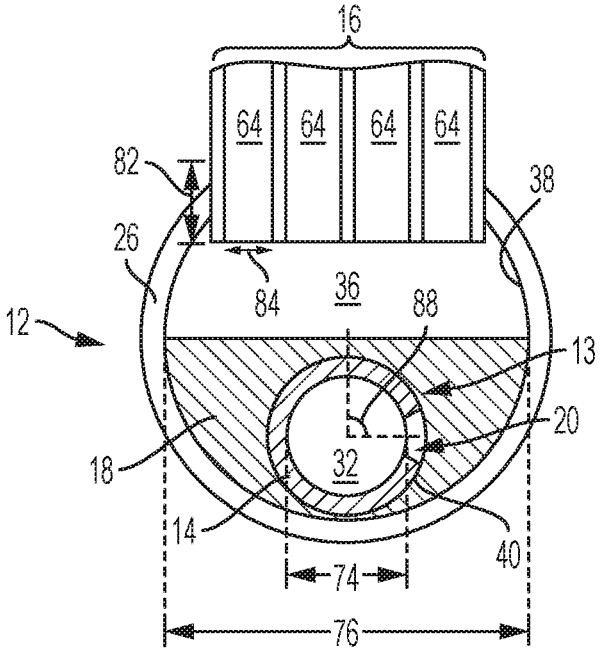
FIG. 5 illustrates a side cross-sectional view of a fifth example of a manifold comprising a distributor, a separator, and micro-channels.

The plurality of micro-channel passageways 16 may extend into the cavity 36, such that the openings of the micro-channels 64 are located inward from the inner surface 38 of the shell 26, as shown in FIGS. 4 and 5. The micro-channel passageways 16 extend into the cavity 36 by about ⅛ to ⅓ of the diameter of the cavity 36. The separators 18 may extend outward toward the inner surface 38 of the shell 26 and beyond the opening of the micro-channels 64, particularly where the separators 18 extend into the spacer regions 62 as shown in FIGS. 1 and 2.

The opening 20 of the elongated body 14 is angled away from the plurality of micro-channel passageways 16. For example, the opening 20 of the elongated body 14 is rotated about the circumference of the elongated body 14 at an angle 88 which faces away from the openings of the micro-channel passageways 16. The opening 20 may be located substantially opposite from the micro-channel passageways 16, such that the opening 20 faces away from the plurality of micro-channel passageways 16, having a rotated angle 88 about the circumference of substantially 180 degrees, as shown in FIG. 3. This positioning of the opening 20 may create a better distribution of cooling fluid within the plurality of micro-channel passageways 16, as the positioning of the opening 20 shown in FIG. 3 may allow separator 18 to be more effective in transferring the downstream momentum of the cooling fluid escaping from the opening 20 towards the plurality of micro-channel passageways 16.

FIG. 4 illustrates the inlet manifold 12 shown from a side cross-sectional view. As shown in FIG. 4, the separator 18 may be coupled to and extending outwardly from the outer surface 40 of the elongated body 14. The outward edge of the separator 18 may contact the inner surface 38 of the shell 26, or a gap 34 may exist to facilitate easier removal of the distributor 13 from the inlet manifold 12 for repair and maintenance. The separator 18 may extend around only a portion of the outer surface 40 of the elongated body 14. The separator 18 may extend outwardly in an arc having an angular width. The separator 18 may be aligned within the cavity to overlap with the opening 20. The angular width of the separator 18 may be centered on the opening 20 to increase the influence of the separator 18 on the cooling fluid escaping from the opening 20. The cross-sectional portion of the cavity 36 in the vicinity of the separator 18 may have a reduced area, but the cross-sectional portion is only partially occluded, allowing at least some cooling fluid to travel upstream or downstream if necessary to allow for even distribution of the cooling fluid in the plurality of micro-channel passageways 16. The separator 18 may have minimum angular width of 9 degrees in order to be effective.

The opening 20 of the elongated body 14 is angled away from the plurality of micro-channel passageways 16, as shown in FIG. 4, having a rotated angle 88 about the circumference of 90 degrees away from the plurality of micro-channel passageways 16. The rotated angle 88 about the circumference may be as small as 60 degrees and as large as 180 degrees. Where the separator 18 is coupled to the elongated body 14 and has a small angular width, as shown in FIG. 4, the opening 20 may be angled away from the plurality of micro-channel passageways 16, such that the separator 18 does not overlap with the plurality of micro-channel passageways 16 within the cross-sectional portion of the cavity 36. This configuration may allow easy insertion and removal of the distributor 13 for repair and maintenance.

FIG. 5 illustrates the inlet manifold 12 shown from a side cross-sectional view. As shown in FIG. 5, the elongated body 14 is biased away from the center of the cavity 36. The elongated body 14 is biased from the center in the direction opposite from the plurality of micro-channel passageways 16. The elongated body 14 may be biased from the center such that the outer surface 40 contacts the inner surface 38 of the shell 26.

The separator 18 extends inwardly from only a portion of the inner surface 38 of the shell 26. As shown in FIG. 5, the separator 18 extends inwardly from the inner surface 38 of the shell 26 on a side of the inlet manifold 12 opposite from the plurality of micro-channel passageways 16. This configuration may be beneficial where the elongated body 14 is biased away from the center in the direction opposite from the plurality of micro-channel passageways 16, or where the opening 20 is angled away from the plurality of micro-channel passageways 16. Alternative, the separator 18 may extend inwardly from an inner surface 38 of the shell 26 on a side of the inlet manifold where the plurality of micro-channel passageways 16 are coupled to the shell 26. This latter configuration may be desirable where the opening 20 is angled toward the plurality of micro-channel passageways 16.

The separator 18 fully encircles the elongated body 14 such that the lateral movement of the elongated body 14 is fully restricted when the elongated body 14 is inserted into the cavity 36. The separator 18 comprises an opening matching the cross-sectional shape of the elongated body 14 to facilitate insertion of the elongated body 14. Alternatively, the separator 18 may comprise a groove (not shown) in the inward edge of the separator 18, wherein the elongated body 14 may rest in the groove when inserted into the cavity 36. In such a configuration the lateral movement of the elongated body 14 may be only partially restricted, and the separator 18 may only partially encircle the elongated body 14.

FIG. 5 illustrates an evaporator 10 comprising the inlet manifold 12, the distributor 13, the plurality of micro-channel passageways 16, a plurality of fins 42, an outlet manifold 44, a collector 46, and the plurality of separators 18. The inlet manifold 12 comprises the inlet 30, the shell 26 defining the cavity 36, the first end 22, and the second end 24. The inlet manifold 12 comprises an endcap 54 configured to receive the distributor. The distributor 13 comprises the elongated body 14 extending into the cavity 36 of the inlet manifold 12 and defining a lumen 32, and the plurality of openings 20 arranged on the outer surface 40 of the elongated body 14 and spaced along the length of the elongated body 14. The plurality of micro-channel passageways 16 extends from the cavity 36 of the inlet manifold 12 to the outlet manifold 44, and allows fluid communication between the inlet manifold 12 and the outlet manifold 44. The plurality fins 42 are be spaced between each of the plurality of micro-channel passageways 16. The plurality of fins 42 are made of any material which has high thermal conductivity, such as a metal or metal alloy. The outlet manifold 44 comprises an endcap 56 configured to receive the collector 46, a first end 48, a second end 50, and defines an outlet cavity 58 configured to receive cooling fluid from the plurality of micro-channel passageways 16. The collector 46 comprises an outlet 52 configured to remove cooling fluid from the evaporator 10, and a side wall 66 extending into the outlet cavity 58 and defining a channel configured to allow fluid communication between the outlet 52 and the outlet cavity 58. The channel of the collector 46 comprises have any shape which allows fluid communication of the cooling fluid, such as a groove or a tube.

Separators 18 are positioned in both the inlet manifold 12 and the outlet manifold 44 to increase even distribution of cooling fluid through the plurality of micro-channel passageways 16. The separators 18 in the inlet manifold 12 and the outlet manifold 44 may have matching positions along the lengths of their respective manifolds 12, 44, or may be staggered such that the separators 18 in the cavity 36 do not overlap with the separators 18 in the outlet cavity 58.

Cooling fluid passing through the evaporator 10 passes into the distributor 13 through the inlet 30. As the cooling fluid travels down the length of the elongated body 14 into the inlet manifold 12, some cooling fluid passes through the plurality of openings 20 in the elongated body 14 into the cavity 36 of the inlet manifold 12. The separators 18 in the cavity 36 ensure even distribution of the cooling fluid through the plurality of micro-channel passageways 16. The cooling fluid exits the plurality of micro-channel passageways 16 into the outlet cavity 58 of the outlet manifold 44. The cooling fluid is then received into the channel of the collector 46 and proceeds through the outlet 52 of the evaporator 10.

The cooling fluid may undergo a change of state while passing through the inlet manifold, 12, the plurality of micro-channel passageways 16, or the outlet manifold. For example, the cooling fluid enters through the inlet 30 as a liquid, and may pass through the outlet 52 as a gas. The length of the plurality of micro-channel passageways 16, under certain operating conditions, may depend on the distribution of the cooling fluid passing through the plurality of micro-channel passageways, such that more even distribution of the cooling fluid may result in the plurality of micro-channel passageways having a shorter length.

Figure 7:
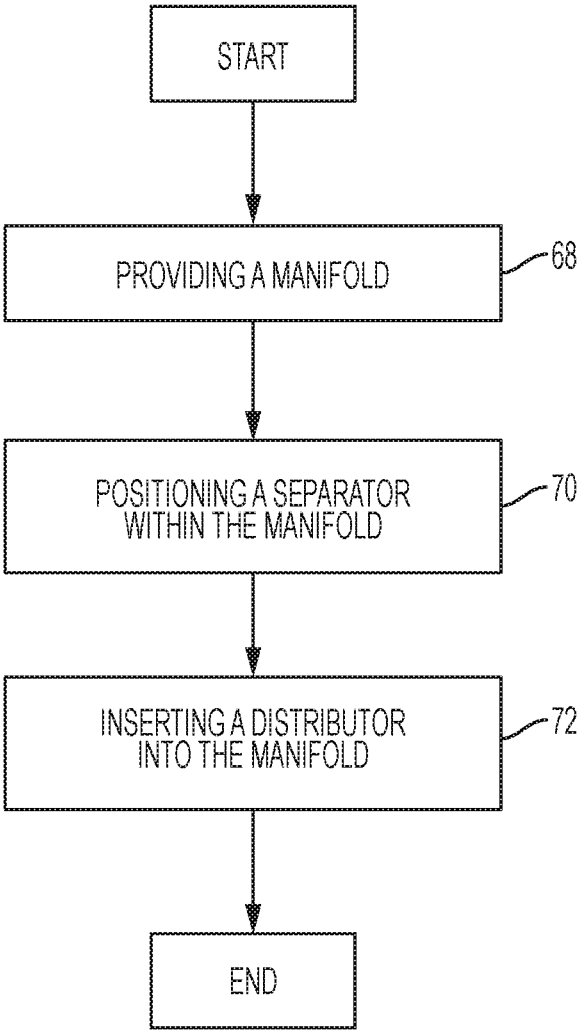
FIG. 7 illustrates a flow diagram of operations to manufacture the evaporator.

FIG. 7 illustrates a method of manufacturing an evaporator 10. The method comprises providing the inlet manifold 12 (68), positioning the separator 18 within the cavity 36 of the inlet manifold 12 (70), and inserting the distributor 13 into the inlet manifold 12 (72). The inlet manifold 12 comprises the shell 26 defining the cavity 36, wherein the inlet manifold is coupled to the plurality of micro-channel passageways 16 which extend outwardly from the inlet manifold 12. The cavity 36 is in fluid communication with the plurality of micro-channel passageways 16. The distributor 13 comprises the inlet 30, the elongated body 14 which extends into the cavity 36 of the inlet manifold 12 and defines the lumen 32, and the plurality of openings 20 arranged on the outer surface 40 of the elongated body 14 and spaced along the length of the elongated body 14. The openings 20 are configured to allow fluid communication between the lumen 32 and the cavity 36 of the inlet manifold 12.

The method may further comprise affixing the separator 18 to the outer surface 40 of the distributor 13 prior to inserting the distributor 13 into the cavity 36 (72). Alternatively or in addition to the step describes above, the method may further comprise affixing the separator 18 to the inner surface 38 of the shell 26 of the inlet manifold 12 prior to inserting the distributor 13 into the inlet manifold 12 (72).

One technical advantage of the systems and methods described below may be that the evaporator described below may have a more efficient distribution of cooling fluid passing through the micro-channel passageways. Another technical advantage of the systems and methods described below may be that the overall size of the evaporator may be reduced as the efficiency of the thermal exchange in the micro-channel passageways increases. Yet another technical advantage of the systems and methods described below may be that the evaporator described below may be more structurally sound, as the separators may provide structural support to the manifold and distributor.

In addition to the advantages that have been described, it is also possible that there are still other advantages that are not currently recognized but which may become apparent at a later time. While various embodiments have been described, it will be apparent to those of ordinary skill in the art that many more embodiments and implementations are possible. Accordingly, the embodiments described herein are examples, not the only possible embodiments and implementations.

We claim:

1. An evaporator comprising:

a manifold comprising a shell defining a cavity, a first manifold end, and a second end;

a plurality of micro-channel passageways extending outwardly from the shell of the manifold, wherein the cavity is in fluid communication with the plurality of micro-channel passageways terminating in open ends inside the cavity;

a distributor comprising an inlet, an elongated body extending from the inlet through one of the first and second manifold ends into the cavity of the manifold and defining a lumen surrounded by an outer wall forming an outer surface, and a plurality of openings extending through the outer wall of the elongated body and spaced along a length of the elongated body, wherein the openings are configured to allow fluid communication between the lumen and the cavity of the manifold; and at least one separator positioned between the plurality of openings within the cavity of the manifold and defining compartments within the cavity of the manifold, wherein a plurality of the open ends of the micro-channel passageways are disposed in each compartment, wherein at least one of the at least one separator is placed immediately downstream of one of the openings to counter a momentum of cooling fluid entering the distributor through the inlet and to change a motion of the cooling fluid toward the closest of the plurality of micro-channel passageways.

2. The evaporator of claim 1, wherein the elongated body of the distributor is substantially centered in the cavity.

3. The evaporator of claim 1, wherein the elongated body of the distributor is biased away from a center of the cavity in a direction opposite from the plurality of micro-channel passageways.

4. The evaporator of claim 1, wherein the openings on the outer surface of the elongated body are angled away from the plurality of micro-channel passageways.

5. The evaporator of claim 4, wherein the openings on the outer surface of the elongated body are angled such that they are opposite from the plurality of micro-channel passageways.

6. The evaporator of claim 1, wherein the separator is coupled to and extends outwardly from the outer surface of the distributor.

7. The evaporator of claim 1, wherein the separator is coupled to and extends inwardly from an inner surface of the shell.

8. The evaporator of claim 1, wherein a cross-sectional portion of the cavity is occluded by the elongated body and the separator.

9. The evaporator of claim 1, wherein a cross-sectional portion of the cavity is partially occluded by the elongated body and the separator.

10. The evaporator of claim 1, wherein the separator extends inwardly from an inner surface of the shell on a side of the manifold opposite from the plurality of micro-channel passageways.

11. The evaporator of claim 1, wherein the separator extends inwardly from an inner surface of the shell on a side of the manifold coupled to the plurality of micro-channel passageways.

12. The evaporator of claim 1, wherein the separator is circumferentially aligned within the cavity to angularly overlap with at least one of the openings of the distributor.

13. The evaporator of claim 1, wherein the at least one separator is a plurality of separators.

14. The evaporator of claim 13, wherein the plurality of separators are evenly spaced in the cavity between a first end and a second end of the manifold.

15. An evaporator comprising: an inlet manifold comprising a shell defining a cavity, a first manifold end, and a second manifold end, a distributor arranged in the inlet manifold the distributor having an inlet and an elongated body extending from the inlet through one of the first and second manifold ends into the cavity of the manifold and defining a lumen surrounded by an outer wall forming an outer surface, and a plurality of openings extending through the outer wall of the elongated body and spaced along a length of the elongated body; at least one separator positioned along a length of the distributor within the cavity of the manifold and defining compartments within the cavity of the manifold, wherein at least one of the at least one separator is placed immediately downstream of one of the openings to counter a momentum of cooling fluid entering the distributor through the inlet and to change a motion of the cooling fluid toward the closest of the plurality of micro-channel passageways; a plurality of micro-channel passageways extending outwardly from the shell of the inlet manifold, each of the plurality of micro-channel passageways comprising a first end and a second end, wherein the first end is in fluid communication with the cavity of the inlet manifold; and an outlet manifold in fluid communication with the second end of the plurality of micro-channel passageways, wherein a plurality of the first ends of the micro-channel passageways are disposed in each compartment;

further comprising a collector having an outlet, a side wall extending into an outlet cavity of the outlet manifold and defining a channel configured to allow fluid communication between the outlet and the outlet cavity of the outlet manifold.

16. An evaporator comprising:

a manifold comprising a shell defining a cavity, a first manifold end, and a second manifold end;

a plurality of passageways extending outwardly from the shell of the manifold, wherein the cavity is in fluid communication with the plurality of micro-channel passageways;

a distributor comprising an inlet, an elongated body extending from the inlet through one of the first and second manifold ends into the cavity of the manifold and defining a lumen surrounded by an outer wall forming an outer surface, and a plurality of openings extending through the outer wall of the elongated body and spaced along a length of the elongated body, wherein the openings are configured to allow fluid communication between the lumen and the cavity of the manifold; and a plurality of separators positioned within the cavity of the manifold, at least two of the plurality of separators connected by a bracket, at least one separator positioned between the plurality of openings within the cavity of the manifold and defining compartments within the cavity of the manifold, wherein a plurality of the open ends of the micro-channel passages are disposed in each compartment, wherein at least one of the at least one separator is placed immediately downstream of one of the openings to counter a momentum of cooling fluid entering the distributor through the inlet and to change a motion of the cooling fluid toward the closest of the plurality of micro-channel passageways.

17. The evaporator of claim 16, wherein the bracket is coupled to an inner surface of the shell.

18. The evaporator of claim 16, wherein at least one of the openings is arranged between the at least two of the plurality of separators connected by a bracket.

* * * * *